US006011356A

United States Patent [19]

Janning et al.

[11] Patent Number: 6,011,356

[45] Date of Patent: Jan. 4, 2000

[54] FLAT SURFACE EMITTER FOR USE IN FIELD EMISSION DISPLAY DEVICES

[75] Inventors: John L. Janning; Robert L. Clark, both of Dayton, Ohio

[73] Assignee: St. Clair Intellectual Property Consultants, Inc., Grosse Pointe, Mich.

[21] Appl. No.: 09/070,398

[22] Filed: Apr. 30, 1998

[51] Int. Cl.[7] ..... H01J 1/30

[52] U.S. Cl. ..... 315/169.4; 315/169.4; 313/309; 345/74

[58] Field of Search ..... 315/169.1, 169.2, 315/169.3, 169.4, 3; 313/309, 311; 345/74, 77, 89, 90, 100

[56] References Cited

U.S. PATENT DOCUMENTS

| | | | |
|---|---|---|---|
| 5,099,296 | 3/1992 | Mort et al. | 357/22 |
| 5,412,285 | 5/1995 | Komatsu | 315/169.1 |
| 5,430,348 | 7/1995 | Kane et al. | 315/169.4 |
| 5,469,014 | 11/1995 | Itoh et al. | 315/169.4 |
| 5,557,159 | 9/1996 | Taylor et al. | 315/169.3 |
| 5,578,906 | 11/1996 | Smith | 315/169.3 |
| 5,633,513 | 5/1997 | Koyama et al. | 257/77 |
| 5,866,988 | 2/1999 | Oda | 315/169.1 |

*Primary Examiner*—Don Wong
*Assistant Examiner*—Wilson Lee
*Attorney, Agent, or Firm*—Harness, Dickey & Pierce, P.L.C.

[57] ABSTRACT

For use in cathodoluminescent field emission display devices, a cathode emitter can comprise an inverted field effect transistor having a diamond film or other low effective work function material deposited onto the channel layer of the transistor, such that the diamond film provides a source of primary electron emissions. A variable voltage source is applied to the gate of the transistor creating an electric field that controls the conductivity of the channel layer, thereby activating or deactivating electron emissions from this cathode emitter structure. In addition, electron blocking junctions can be incorporated into the emitter structure to inhibit current flow through the device during a deactivated state. In a variation, the transistor of the cathode emitter has the diamond film being deposited onto an electrically conductive pad that is electrically connected to, and extending outwardly from, the transistor. Alternatively, a sideways laterally gated transistor structure can be used with the emitter surface being applied to the transistor's drain. A near mono-molecular oxide film of high secondary electron emission material can also be included on the emitter surface for enhanced electron emissions.

49 Claims, 2 Drawing Sheets

FLAT SURFACE EMITTER FOR USE IN FIELD EMISSION DISPLAY DEVICES

This invention relates to electronic field emission display devices, such as matrix-addressed monochrome and full color flat panel displays in which light is produced by using cold-cathode electron field emissions to excite cathodoluminescent material, and in particular to a transistor controlled flat film cathode emitter for use in a field emission display device. Such display devices use electric fields to induce electron emissions, as opposed to elevated temperatures or thermionic cathodes as used in cathode ray tubes.

BACKGROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or HDTV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between neighboring pixels are associated issues.

Vacuum fluorescent displays (VFDs), like CRTs, use cathodoluminescence, vacuum phosphors, and thermionic cathodes. Unlike CRTs, to emit electrons a VFD cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VFD thermionic cathodes generally have emission current densities that are not sufficient for use in high brightness flat panel displays with high voltage phosphors. Another and more general drawback is that the entire electron source must be left on all the time while the display is activated, resulting in low power efficiencies particularly in large area VFDs.

Against this background, field emission displays (FEDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation. High voltage sulfur based phosphors can be used, as well as low voltage phosphors when they become available.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric fields can be achieved at lower voltage levels.

Each FED emitter is typically a miniature electron gun of micron dimensions. When a sufficient voltage is applied between the emitter tip or edge and an adjacent gate, electrons are emitted from the emitter. The emitters are biased as cathodes within the device and emitted electrons are then accelerated to bombard a phosphor generally applied to an anode surface. Generally, the anode is a transparent electrically conductive layer such as indium tin oxide (ITO) applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures and strike phosphor areas.

FEDs are generally energy efficient since they are electrostatic devices that require no heat or energy when they are off. When they operate, nearly all of the emitted electron energy is dissipated on phosphor bombardment and the creation of emitted unfiltered visible light. Both the number of exciting electrons (the current) and the exciting electron energy (the voltage) can be independently adjusted for maximum power and light output efficiency. FEDs have the further advantage that each pixel can be operated by its own array of emitters activated in parallel to minimize electronic noise and provide redundancy, so that if one emitter fails the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

Due to the inherent problems, notably the expense of manufacture, associated with microtip or "Spindt" type emitters, recent developments in the area of FEDs have focused on flat surface emitters. In particular, much work is being done in the area of diamond electron emitters for FEDs because of its low electron affinity and high temperature properties. For example, amorphic sputtered or CVD diamond films, or boron doped films of type II-b diamond (more commonly known as p-type diamond), have been disclosed for use as flat film electron emitter surfaces in FED devices. See, e.g., U.S. Pat. Nos. 5,449,970; 5,543,684; and 5,686,791. (Such diamond films have also been independently disclosed for general use in thin film transistors having high temperature applications. For instance, U.S. Pat. No. 5,633,513 discloses the fabrication of a field effect thin diamond film depletion type transistor and U.S. Pat. No. 5,099,296 also shows the fabrication of a diamond thin film transistor.) While n-type diamond has been produced and in theory could function for a flat electron emissive surface, its use is unattractive at present due to manufacturing difficulties and cost. Intrinsic or undoped diamond materials are insulators and do not possess the low electron affinities that render p-type diamond desirable for use in flat surface cathode electron emitters. Since extremely low electric field strengths are required to remove electrons from the surface of p-type diamond, due to its low effective work function and negative electron affinity, this material may well become the electron emitter material of choice for FED devices.

However, the prior art has thus far failed to satisfactorily address mechanisms for switching proposed flat surface emitter structures between on and off states of electron emission, or for otherwise controlling the electron emissions to vary the brightness or gray scale of light emitted by a cathodoluminescent FED device. Ideally, electron emissions should be controllable by low voltage level signals capable of being switched at high speeds, as opposed to the much higher anode to cathode voltages generally required to accelerate emitted electrons to bombard the display phosphors at cathodoluminescent energy levels. If the normal anode to cathode biasing is to be continuously applied, the tendency of a p-type diamond emitter to continuously emit electrons due to forward biasing by the applied acceleration field is a problem that must be managed.

Thus, while the FED technology holds out many promises, existing designs are not without drawbacks. Extensive research and development has been devoted to FEDs in recent years, and yet problems remain unsolved. It was against this background that the present invention has been conceived.

OBJECTS OF THE INVENTION

It is accordingly an object of this invention to provide a low cost, high efficiency field emission display having the superior optical characteristics generally associated with the traditional CRT technology, in the form of a digital device with flat panel packaging.

Another object of the invention is to provide a field emission display device, for either monochrome or full color applications, with improved light conversion efficiencies.

Another object of the invention is to provide a field emission display device with a flat surface emitter that avoids yield problems and high manufacturing costs associated with microtip cathode emitters.

Another object of the invention is to provide a cathode emitter structure comprised of a field effect transistor for electrically gating an emitter surface element and thus activating, and deactivating and otherwise controlling the primary source of electron emissions.

Another object of the invention is to provide a cathode emitter structure comprised of a field effect transistor that incorporates electrical blocking junctions to facilitate low voltage activation, deactivation or other control of the FED device using a p-type flat surface emitter.

Another object of the invention is to provide a field emission display device that utilizes a diamond film or other low effective work function material as an emitter surface element on the transistor based cathode emitter that will function with a continuously applied anode to cathode acceleration field within the FED device.

SUMMARY OF THE INVENITON

The invention applies generally to field emission display (FED) devices having a faceplate electrically biased as an anode with respect to a cathode emitter, and a light emitting layer of cathodoluminescent material for bombardment by electrons resulting from operation of the cathode emitter. The cathode emitter can include a field effect transistor having a p-type diamond film or other low effective work function material, deposited or otherwise disposed on the anode side of an electrically gated channel layer of an inverted or "upside down" transistor structure, for providing a source of primary electron emissions in an FED device. Alternatively, a laterally gated vertical channel or "sideways" field effect transistor structure can be used, with the flat emitter surface material applied to the transistor's drain element. In still another construction, the flat surface cathode emitter can include a doped diamond film or other low effective work function material disposed on an electrically conductive pad that is electrically connected to the drain of an adjacent field effect transistor, for providing a source of primary electron emissions in the FED device. A variable low voltage source can be applied to the gate of the field effect transistor, creating an electric field that controls the conductivity of the channel layer, thereby activating, deactivating or otherwise modulating electron emissions from the low effective work function material of the cathode emitter structure.

Electron blocking junctions can be incorporated into the emitter structure where needed to inhibit anode current flow through the device during a deactivated state when the anode to cathode acceleration field potential is continuously applied. Further, in conjunction with the various embodiments, or flat surface electron emitters in general, a thin near mono-molecular film of a high secondary emission material can advantageously be deposited on the emitter material, to form the flat electron emitting surface, and thereby enhance electron emissions from the emitter. Preferred high secondary emission materials include magnesium oxide, aluminum oxide or beryllium oxide.

The above-mentioned and other objects, features and advantages of the invention will become apparent from the further descriptions and the attached drawings.

DETAILED DESCRIPTION OF THE PRESENTLY PREFERRED EMBODIMENTS

Figure 1:
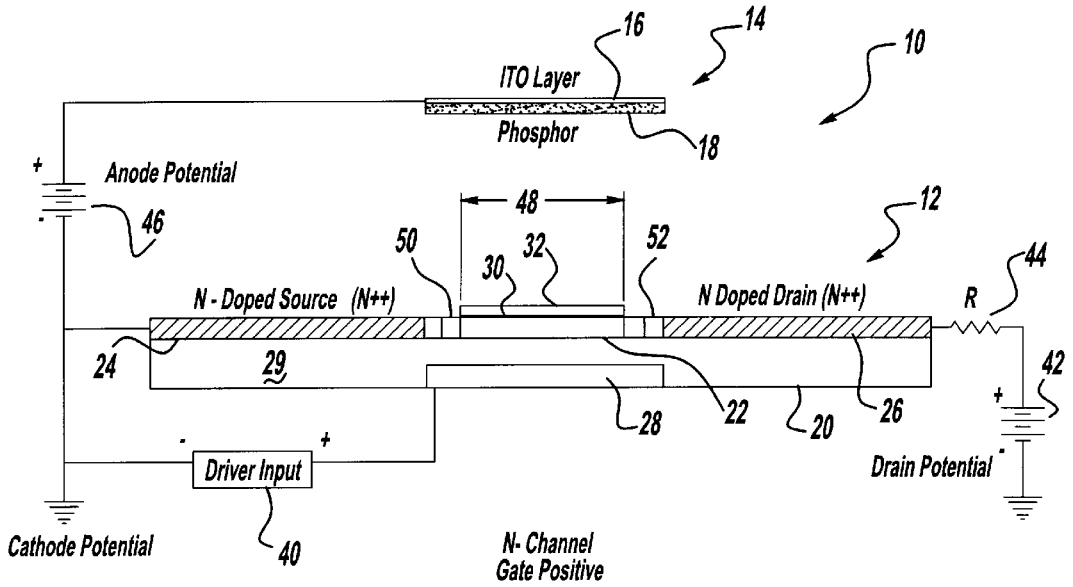
FIG. 1 is a cross sectional schematic view of an exemplary field emission display device having a cathode emitter comprised of a diamond emitter surface element coupled to an electrically gated channel layer of an inverted thin film n-p-n transistor with commonly gated electron blocking junctions.

FIG. 1 schematically depicts a field emission display (FED) device 10 having a flat surface cathode emitter 12 which uses cathodoluminescence of a light emitting layer 14 as a principle of operation. Generally, a field emitter cathode matrix may be opposed by a phosphor-coated, transparent faceplate that serves as an anode and has a positive voltage relative to the emitter array matrix. The FED devices can incorporate a transparent conductive layer 16 such as indium tin oxide (ITO), applied to the inside surface of the faceplate 17, or between the faceplate and a phosphor coating 18, to provide the anode electrode applicable biasing with respect to the cathode-emitters. The conductive layer 16 and the phosphor coating 18 may be masked or patterned on the faceplate to provide a matrix of x-y addressable pixels, with addressing provided via a selective cathode-emitter activation.

Cathode emitter 12 is a flat surface emitter structure comprised of an emitter surface element 30 in conjunction with a field effect transistor 20. Transistor 20 is built upside-down on a suitable substrate and preferably can be fabricated from silicon, amorphous silicon or polysilicon material. Transistor 20 includes a channel layer 22 disposed between a source element 24 and a drain element 26. By building the transistor "upside down", the channel layer 22 of transistor 20 provides an exposed or uncovered surface on which emitter surface element 30 can be disposed for electron emissions. The transistor is called "upside down" to contrast with the more common field effect transistor structures in which the transistor gate is fabricated over top of the channel area.

As further shown in FIG. 1, a gate element 28 for transistor 20 is disposed beneath the channel layer 22, on the opposite side from emitter surface element 30 on the channel layer 22, and can be constructed from either a metal or silicon layer which is separated from the channel layer 22 by an electrically insulating oxide layer 29. The channel layer 22 may be disposed on a substrate, e.g., a glass or silicon substrate, in various patterns, including but not limited to interdigitated, serpentine, comb or spiral patterns.

In the preferred embodiment of the invention, a thin p-type diamond film is deposited over the channel 22 of inverted transistor 20 to serve as emitter surface element 30. However, emitter surface element 30 may also be comprised of other negative electron affinity or low effective work function material. Preferably, the thin boron doped p-type diamond film is deposited to a thickness on the order of 100 Angstroms and can become the emitter for one pixel or a group of pixels. With a preferred impurity concentration of between $10^{16}/cm^3$ to $10^{20}/cm^3$ for the boron doping, the effective "shunt" resistance of the emitter surface element 30 is very large in the direction of the length of the channel layer 22 (from source to drain), but is relatively insignificant across the thickness of the emitter surface element 30, which is the path of the anode current flow.

When the FED 10 is operational, electrons will easily flow from an inverted p-type silicon channel layer 22 (which becomes n-type when the transistor is conducting) to the forward biased p-type diamond film 30 enroute to light emitting layer 14. In other words, an anode current flows from light emitting layer 14 through the emitter surface element 30 and into channel layer 22 of cathode emitter 12, while emitted electrons flow from cathode to anode. A path for the anode current is provided by the channel layer 22 being electrically coupled to a cathode potential (e.g., ground) through the source element 24. To activate the diamond film of emitter surface element 30, a gate potential, which can be on the order of about 2–5 volts, can be applied by a variable voltage source 40 to gate element 28. The gate potential varies the electrical resistance provided by the channel layer 22 between emitter surface element 30 and the cathode potential, thereby controlling electron emissions from the cathode emitter. To provide conductance across channel layer 22 of the transistor, a drain voltage source 42, on the order of about 5–7 volts, can be electrically coupled to the channel layer 22 through a load resistance 44 in series with the drain element 26.

In an operational FED, the emitted electrons are accelerated toward the light emitter layer 14 to bombard the intervening phosphors 18. Phosphors 18 are in turn induced into cathodoluminescence by the bombarding electrons, thus emitting light through the faceplate for observation by a viewer. The operational acceleration potential is applied by an anode voltage source 46 that is electrically connected between the anode and the cathode potential, which can be on the order of 500 to 1000 volts for FEDs using high-voltage, sulfur-based phosphors. It should also be noted that the variable voltage source 40 can be modulated (e.g., by amplitude, duty cycle or pulse width) to control the gray scale and/or brightness of light being emitted by the light emitter layer 14 when the device is activated.

Figure 2:
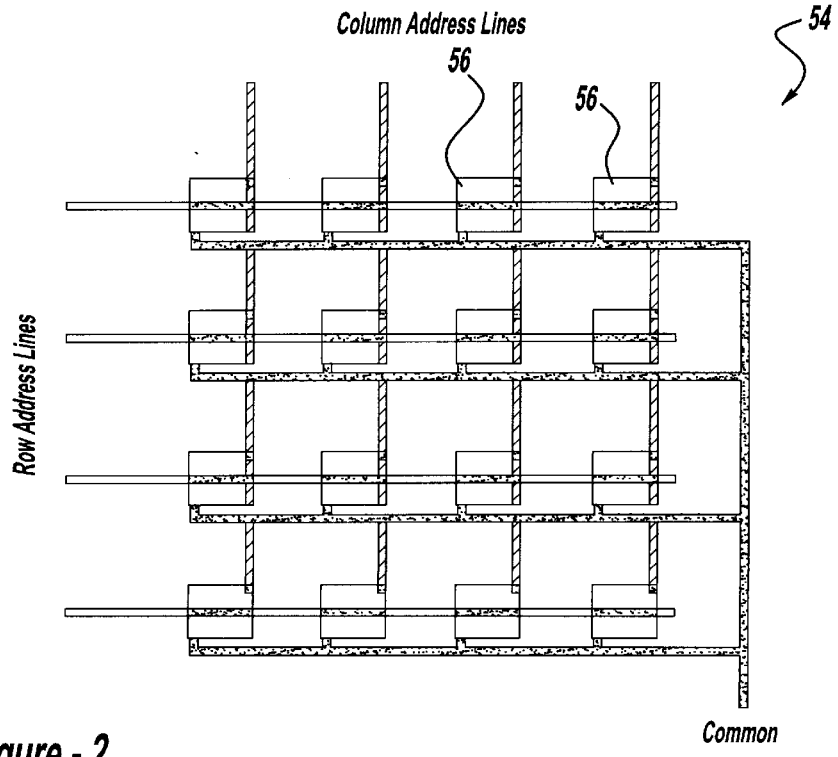
FIG. 2 is top view of an exemplary 4×4 matrix of an integrated circuit type emitter layout for use in a field emission display device.

Bi-polar electron blocking structures made from a semiconductor material can be incorporated into the FED to prevent conductivity when the device is in a deactivated state. A first p-n electron blocking junction 50 is placed in series between the source element 24 and the channel layer 22, and a second p-n electron blocking junction 52 is placed in series between the drain element 26 and the channel layer 22. Because both of the blocking junctions are disposed directly over the dielectrically isolated gate element 28, current flow through the device can still be controlled by potential supplied to a single gate electrode. Use of blocking junctions 50 and 52 in conjunction with the illustrated n-p-n field effect transistor structure shown in FIG. 1 is designed to inhibit the forward biasing nature of unwanted anode currents. However, in a configuration using a p-n-p type field effect transistor structure, the drain to channel and source to channel junctions would tend to be reversed biased by the anode to cathode acceleration potential, and while further electron blocking structures could also be incorporated, the need for their use is thus mitigated. To inhibit arcing and unwanted current flows, the exposed surfaces of the non-emissive transistor and/or electron blocking junctions can be covered by an oxide or other insulating layer (not shown). The FED structure shown in FIG. 1 can be fabricated in an array or other desired pattern. FIG. 2, for example, shows a simple 4×4 matrix of an integrated circuit type cathode emitter structure 54 with row and column addressing lines. The transistors 56 of the cathode structure 54 can be are fabricated "upside down" with their gate electrodes on the bottom of the FED device as previously described. This cathode structure 54 can be fabricated on a glass substrate using CVD deposition of silicon (which could be annealed or could be used as deposited). Alternatively, a similar cathode emitter structure might also be fabricated by depositing cadmium selenide, cadmium sulphide, germanium, gallium arsenide, diamond or other thin film transistor material. Depending on the mobility requirements of the transistors for the functioning specified, a variety of thin film transistor types could be fabricated in a variety of ways.

Fabrication of cathode emitter structures in the above-described manner can easily be accomplished using standard integrated circuit manufacturing processes. Large area fabrication is possible using the same type of integrated circuit processing as used in active matrix LCDs or by using other known fabrication techniques. In addition, multiple gates may be fabricated on each transistor by using a "finger type pattern". While the anode or light emitter layer has not been shown in FIG. 2, it is understood that it is positioned directly above the cathode emitter structure with a positive electrical potential applied to it in reference to the emitter.

In the present invention, gate voltages of only a few volts can control electron emission from the cathode emitter structure. Rather than just pulling electrons from the surface of the cathode emitter by very high fields, which is commonly done, electron emission is controlled by regulating the conductivity in the channel layer of the transistor, so that the higher the conductivity in the channel the larger the number of escaping electrons moving towards the anode from the emitter.

In the preferred embodiment shown in FIG. 1, the central channel semiconductor material is of a p-type with the source element and drain element being of an n-type. In an alternative embodiment of the invention, the cathode emitter can be fabricated with an n-type central channel material with the source element and the drain element being of a p-type. In addition, either embodiment can be made to operate in enhancement mode or depletion mode. It should also be noted that as long as the diamond film is of a p-type (and regardless of what type the channel layer is), there will be no reverse biased emitter junction involved. Despite the difficulty in doping diamond n-type, it is also envisioned that the transistor could be made entirely of diamond. However, because it can be made to easily operate in the enhancement mode, cathode emitters with silicon or polysilicon transistors are the preferred embodiment.

Figure 3:
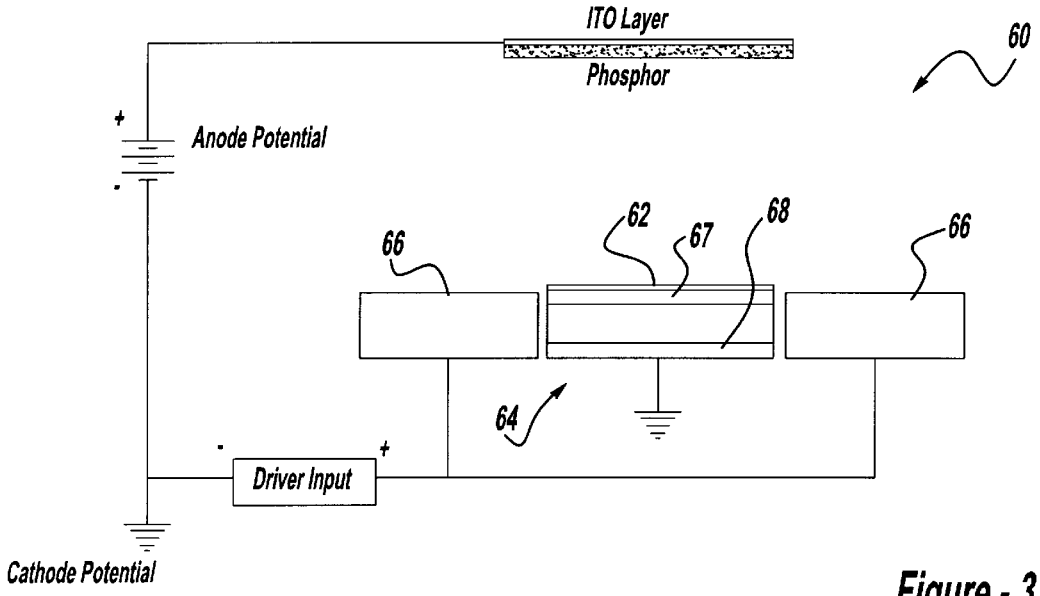
FIG. 3 is a cross sectional schematic view of an exemplary field emission display device having a cathode emitter comprised of a field effect transistor having a vertical electrically gated channel layer with laterally adjacent control electrodes.

Electrical blocking junctions can be incorporated into other embodiments of the invention as may be required, e.g., as shown in FIG. 3. A thin p-type diamond film comprising an emitter surface element 62 can be disposed on a gated semiconductor channel 64 for providing electron emissions in the context of an FED device 60. As illustrated, an N++ type material forms a donut-shaped control electrode 66 which is adjacent on all sides to channel layer 64. However, a first junction element 67 (drain) and a second junction element 68 (source) are used in this device to form, in effect, a laterally gated "sideways" n-p-n field effect transistor, to prevent conductivity when the device is in a deactivated state. Each of these n-type material transistor junction elements is used in combination with the p-type channel 64 to inhibit current flow and thus enable proper turn on and off characteristics. In addition, junction elements 67 and 68 can enable FED device 60 to modulate the flow of electrons towards the anode through control of the voltage applied to the intervening channel layer through control electrode 66. Variations to this structure including n-p-n as well as p-n-p structures could also be used. To inhibit arcing and unwanted current flows, the exposed surfaces of the non-emissive transistor elements can be covered by an oxide or other insulating layer (not shown).

In operation, the p-type diamond layer 62 disposed over the n-type transistor drain region 67 is "connected" when the device shown in FIG. 3 is turned "on". This happens when the p-type region is inverted along the sides of the channel layer 64 facing the control electrode 66. Inverting this p-type region to n-type evenly connects the diamond emitter 62 to ground, thereby providing electron emission. Electron emission thus occurs from the entire surface of the p-type emitter surface element 62, which is forward biased with respect to the underlying n-type transistor drain region 67, therefore resulting in increased electron flow for this embodiment of the invention.

Figure 4:
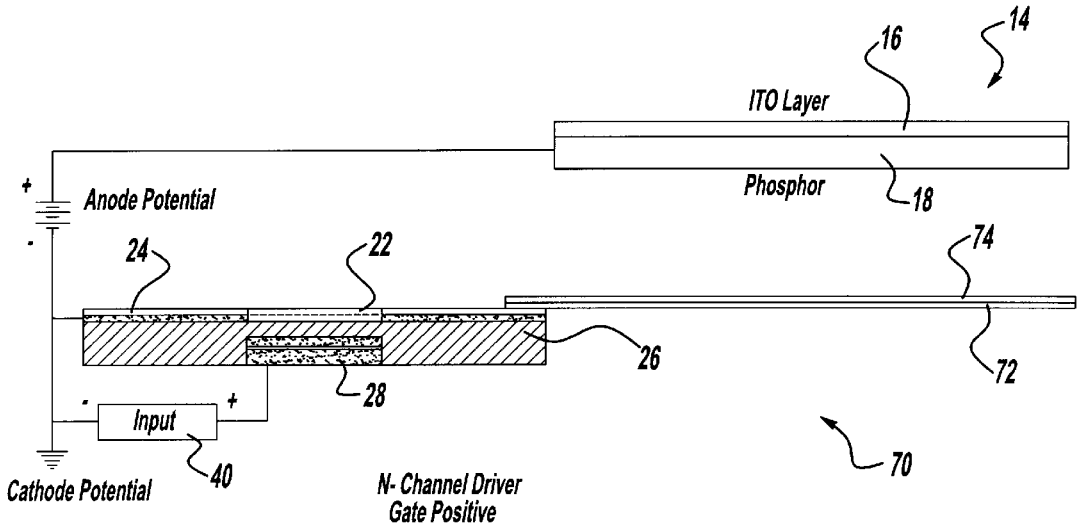
FIG. 4 is a cross sectional schematic view of an exemplary field emission display device having a cathode emitter comprised of a diamond emitter surface element coupled to an electrically conductive pad which in turn is coupled to the drain element of an adjacent n-p-n field effect transistor having an electrically gated channel layer.

Alternatively, a cathode emitter 70 can be constructed by disposing a diamond film or other low effective work function material onto a conductive pad 72 which can be adjacent to the transistor structure as shown in FIG. 4. Conductive pad 72 overlaps with drain element 26 and can extend outwardly to form the substrate base for an emitter surface element 74. Conductive pad 72 is constructed from transparent ITO or other electrical conductors. Rather than covering the channel layer, the p-type diamond film which serves as emitter surface element 74 can be deposited onto the conductive pad 72 as shown in FIG. 4.

In operation, when the transistor conducts, the emitter material on conductive pad is "connected" and when at ground potential it becomes an electron emitter. As shown schematically in FIG. 2, a matrix transistor-emitter configuration can be used, similar to a conventional active matrix LCD device configuration in which light transmitting elements are turned "on" and "off" using associated control transistors. For a full color FED display device, every third device can be red with the remaining two divided between green and blue. To keep the cathode to anode distance quite uniform throughout the display, the disclosed FED devices can use tiny glass spacers sprayed onto the cathode emitter surface before assembly. In this manner, a color field emission display device can be constructed. To inhibit arcing and unwanted current flows, the exposed surfaces of the non-emissive transistor elements can be covered by an oxide or other insulating layer (not shown).

The power for transistor operation in the embodiments shown in FIGS. 3 and 4 comes from the anode potential, whereas in the first embodiment (shown in FIG. 1) the transistor has its own separate (drain) power supply. Referring to FIGS. 3 and 4, there is no separate battery connection to the drain electrode of the transistor. Therefore, the transistor receives its power from the anode as the device is in series, i.e., the anode voltage is distributed across the gap between anode and transistor drain so that current flows across the channel layer and through the source element to ground.

For FEDs using high voltage phosphors, particularly when using emitter structures of the type shown in FIG. 4, it is presently preferred that the anode-emitter capacitance be less than one-fourth the capacitance of the transistor channel 22. This relationship between capacitances can be achieved, for example, by controlling the length of the transistor channel 48 (distance from source to drain) for a given anode to emitter spacing, to allow for proper activation and deactivation of the device. The reason for the attention to capacitance is because of the sharp turnon characteristic curve that can be applicable when high voltage is applied between field emitters and the anode. Current is practically non-existent until a "breakdown" voltage is reached, and at this point, current can rise sharply. If the capacitance is not within an operational range, source to drain shorting or breakdown of the transistor can occur. Therefore, the capacitance between the cathode and anode should preferably be less than one-fourth the capacitance across the channel layer, for use in FEDs using high voltage phosphors or other cathodoluminescent materials having a comparable turn-on characteristic curve.

In each of the above-described embodiments, as well as other flat surface emitter structures generally, a thin near mono-molecular film of a high secondary emission material can be disposed on the emitter base material to enhance electron emission from the flat surface cathode emitter. For instance, a mono-molecular film 32 is shown in FIG. 1. Preferred high secondary electron emission materials include magnesium oxide, aluminum oxide or beryllium oxide. With a thin film of such material deposited on the electron emissive surfaces with a near mono-molecular thickness (approximately 10–15 Angstroms), electron emission can be significantly enhanced.

While the presently preferred embodiments of the invention have been illustrated and described, it will be understood that those and yet other embodiments may be within the scope of the following claims.

What is claimed is:

1. In a field emission display device including a cathode electron emitter, a faceplate electrically biased with respect to the emitter and a light emitting layer of cathodoluminescent material for bombardment by electrons resulting from operation of the cathode emitter, the improvement comprising:

a field effect transistor defining the cathode emitter, said field effect transistor having an emitter surface element disposed on an exposed surface of a channel layer of said transistor such that said emitter surface element facing the anode, said emitter surface element being comprised of a low effective work function material for providing primary electron emissions.

2. The field emission display device of claim 1 wherein said emitter surface element comprises a p-type diamond film.

3. A field emission display device, which comprises:

a faceplate through which emitted light is transmitted from an inside surface to an outside surface of the faceplate for viewing;

a cathode emitter having an emitter surface element deposited on a channel layer of an inverted field effect transistor, said emitter surface element being comprised of a low effective work function material for providing primary electron emissions;

an anode, comprising a layer of electrically conductive material disposed between the inside surface of the faceplate and the emitter surface element side of said cathode emitter; and a light emitter layer of cathodoluminescent material capable of emitting light through the faceplate in response to bombardment by electrons emitted within the device, disposed between the anode and the cathode emitter.

4. The field emission display device of claim 3 wherein said transistor being further defined as said channel layer being disposed between a source element and a drain element, whereby said transistor being electrically coupled to a cathode potential through said source element, and a gate element disposed on the opposite side of said channel layer from said emitter surface element.

5. The field emission display device of claim 4 wherein said gate element comprises at least one of a metal layer and a silicon layer separated from said channel layer by an oxide layer for providing electrical insulation.

6. The field emission display device of claim 4 further comprising a variable voltage source electrically coupled to said gate element, such that the electrical resistance of said channel layer varies in response to an electrical field created by said variable voltage source, thereby controlling electron emissions from said emitter surface element.

7. The field emission display device of claim 6 wherein said variable voltage source being modulated to control at least one of gray scale and brightness of light emitted by said light emitter layer.

8. The field emission display device of claim 4 wherein a capacitance across said channel layer being at least four times a capacitance between said cathode emitter and said light emitter layer.

9. The field emission display device of claim 4 further comprising an anode voltage source electrically coupled between said anode and said cathode potential for applying a bias voltage, and a drain voltage source electrically coupled to said channel layer through a load in series with said drain element for providing conductance across said channel layer.

10. The field emission display device of claim 4 further including a first semiconductor electron blocking junction in series between said source element and said channel layer, and a second semiconductor electron blocking junction in series between said drain element and said channel layer, thereby inhibiting current flow during deactivation of the field emission display device.

11. The field emission display device of claim 10 wherein said first and second electron blocking junctions being disposed over said gate element for controlling electron emission from said emitter surface element.

12. The field emission display device of claim 4 further including at least one semiconductor electron blocking junction disposed between said source element and said channel layer, thereby inhibiting current flow during deactivation of the field emission display device.

13. The field emission display device of claim 3 wherein said emitter surface element comprises a p-type diamond film.

14. The field emission display device of claim 3 wherein said emitter surface element comprises a film having a thickness on the order of 100 Angstrom.

15. The field emission display device of claim 3 wherein said transistor further comprises an n-p-n transistor fabricated from silicon onto a substrate.

16. The field emission display device of claim 3 wherein said transistor further comprises an p-n-p transistor fabricated from silicon onto a substrate.

17. The field emission display device of claim 4 further comprising an electrical insulator being disposed on each of an exposed surface of said source element and on an exposed surface of said drain element.

18. The field emission display device of claim 10 further comprising an electrical insulator being disposed on each of an exposed surface of said source element, on an exposed surface of said drain element, and on an exposed surface of said first and second electron blocking junctions.

19. The field emission display device of claim 3 further comprising a near mono-molecular thin layer which overlays a side of said emitter surface element facing the anode for providing enhanced secondary emissions of electrons from said cathode emitter.

20. The field emission display device of claim 19 wherein said mono-molecular thin layer comprises one or more materials selected from the group comprising magnesium oxide, aluminum oxide and beryllium oxide.

21. The field emission display device of claim 20 wherein said mono-molecular thin layer has a thickness on the order of 10 Angstroms.

22. In an electron emitter device including an anode for bombardment by electrons resulting from operation of a cathode electron emitter, and said cathode electron emitter having an emitter surface element disposed on the anode side of an electrically gated semiconductor material, the improvement comprising:

at least one semiconductor electron blocking junction disposed onto the surface of the gated semiconductor material, said electron blocking junctions being reversed bias by an anode-to-cathode potential to inhibit current flow during deactivation of the cathode emitter.

23. The electron emitter device of claim 22 wherein the cathode emitter being further defined as an inverted field effect transistor having the emitter surface element deposited on a channel layer of said transistor and said channel layer being disposed between a source element and a drain element, such that said anode-to-cathode potential being electrically connected through said source element.

24. The electron emitter device of claim 23 wherein a first electron blocking junction being disposed between said source element and said channel layer, and a second electron blocking junction being disposed between said drain element and said channel layer, thereby inhibiting current flow during deactivation of the cathode emitter.

25. The electron emitter device of claim 24 wherein said first and second blocking junctions and said channel layer are disposed over a gate element of said transistor, thereby controlling electron emissions from said emitter surface element.

26. The electron emitter device of claim 22 wherein a first electron blocking junction being disposed between the emitter surface element and the gated semiconductor material, and a second electron blocking junction being disposed between the gated semiconductor material and a cathode potential device, such that said anode-to-cathode potential being electrically connected through the gated semiconductor material and at least one of said blocking junctions during activation of the cathode emitter.

27. The electron emitter device of claim 26 wherein the cathode emitter being electrically gated by a control electrode disposed substantially peripherally about said gated semiconductor material, and said first and second electron blocking junctions being disposed on opposite sides of said gated semiconductor material, thereby forming a laterally gated field effect transistor.

28. A field emission display device, which comprises:

a faceplate through which emitted light is transmitted from an inside surface to an outside surface of the faceplate for viewing;

a cathode emitter for providing a source of primary electron emissions, said cathode emitter includes a field effect transistor having an emitter surface element deposited on an electrically conductive pad that extends adjacent to said field effect transistor, said emitter surface element being comprised of a low effective work function material;

an anode, comprising a layer of electrically conductive material disposed between the inside surface of the faceplate and an emitter surface element side of said cathode emitter; and a light emitter layer of cathodoluminescent material disposed between the anode and the cathode emitter capable of emitting light through the faceplate in response to bombardment by electrons emitted within the device.

29. The field emission display device of claim 28 wherein said transistor being further defined as said channel layer being disposed between a source element and a drain element, whereby said transistor being electrically coupled to a cathode potential through said source element, and a gate element disposed on an opposite side of said channel layer from said emitter surface element.

30. The field emission display device of claim 29 wherein said gate element comprises at least one of a metal layer and a silicon layer separated from said channel layer by an oxide layer for providing electrical insulation.

31. The field emission display device of claim 29 further comprising an anode voltage source electrically coupled between said anode and said cathode potential for applying a bias voltage, and a variable voltage source electrically coupled to said gate element, such that electrical resistance of said channel layer varies in response to an electrical field created by said variable voltage source, thereby controlling electron emissions from said emitter surface element.

32. The field emission display device of claim 31 wherein said variable voltage source being modulated to control at least one of gray scale and brightness of light emitted by said light emitter layer.

33. The field emission display device of claim 29 wherein capacitance across said channel layer being on the order of four times a capacitance between said cathode emitter and said light emitter layer.

34. The field emission display device of claim 29 further including a first electron blocking junction in series between said source element and said channel layer, and a second electron blocking junction in series between said drain element and said channel layer, thereby inhibiting current flow during deactivation of the field emission display device.

35. The field emission display device of claim 34 wherein said blocking junctions being disposed over said gate element for controlling electron emission from said emitter surface element.

36. The field emission display device of claim 28 wherein said emitter surface element comprises a p-type diamond film.

37. The field emission display device of claim 28 wherein said emitter surface element being a film having a thickness on the order of 100 Angstrom.

38. The field emission display device of claim 28 wherein said transistor further comprises an n-p-n transistor fabricated from silicon onto a substrate.

39. The field emission display device of claim 28 wherein said transistor further comprises an p-n-p transistor fabricated from silicon onto a substrate.

40. The field emission display device of claim 29 further comprising an electrical insulator being disposed on each of an exposed surface of said source element and on an exposed surface of said drain element.

41. The field emission display device of claim 29 further comprising an electrical insulator being disposed on each of an exposed surface of said source element, on an exposed surface of said drain element, and on an exposed surface of said first and second electron blocking junctions.

42. The field emission display device of claim 28 further comprising a near mono-molecular thin layer which overlays a side of said emitter surface element facing the anode for enhanced secondary emissions of electrons from said cathode emitter.

43. The field emission display device of claim 42 wherein said mono-molecular thin layer comprises one or more materials selected from the group comprising magnesium oxide, aluminum oxide and beryllium oxide.

44. The field emission display device of claim 43 wherein said mono-molecular thin layer has a thickness on the order of 10 Angstrom.

45. A field emission display device, which comprises:

a faceplate through which emitted light is transmitted from an inside surface to an outside surface of the faceplate for viewing;

a cathode emitter for providing a source of primary electron emissions, said cathode emitter having an electron surface element of a low effective work function material disposed on a laterally gated field effect transistor;

a gated electrode disposed substantially peripherally around said laterally gated field effect transistor and being electrically connected to a variable voltage source for controlling electron emissions from said cathode emitter;

an anode, comprising a layer of electrically conductive material disposed between the inside surface of the faceplate and an emitter surface element side of said cathode emitter; and a light emitter layer of cathodoluminescent material disposed between said anode and said cathode emitter capable of emitting light through the faceplate in response to bombardment by electrons emitted within the device.

46. The field emission display device of claim 45 wherein said field effect transistor having a gated channel layer vertically disposed between a source element and a drain element, said source element and said drain element being reversed bias by an anode-to-cathode potential to inhibit current flow during deactivation of the cathode emitter, and said low effective work function material being disposed on an exposed surface of said drain element facing said anode.

47. The field emission display device of claim 45 wherein said field effect transistor further comprises an n-p-n type semiconductor transistor.

48. The field emission display device of claim 45 wherein said emitter surface element comprises a p-type diamond film having a thickness on the order of 100 Angstroms.

49. The field emission display device of claim 45 further comprising an electrical insulator being disposed on an exposed surface of said gated electrode facing said light emitting layer.

* * * * *